United States Patent [19]

Younge

[11] 4,265,743

[45] May 5, 1981

[54] METHOD OF AND APPARATUS FOR EXTRACTION OF GOLD FROM PLACER GRAVEL

[76] Inventor: Earl G. Younge, c/o P.O. Box 3156, No. 204 - 20559 Fraser Hwy., Langley, British Columbia, Canada, V3A 4R5

[21] Appl. No.: 50,310

[22] Filed: Jun. 20, 1979

[30] Foreign Application Priority Data

Nov. 23, 1978 [CA] Canada ..... 316785

[51] Int. Cl.[3] ..... B03B 5/56

[52] U.S. Cl. ..... 209/452; 209/14; 209/199; 233/14 R

[58] Field of Search ..... 209/14–16, 209/R, 12, 42, 43, 59, 60, 174, 175, 198–200, 445, 451, 452, 444, 435, 155; 233/14 R, 14 A, 1 D

[56] References Cited

U.S. PATENT DOCUMENTS

| | | | |
|---|---|---|---|
| 919,894 | 4/1909 | Leavell | 209/12 X |
| 980,001 | 12/1910 | Ponten | 233/14 R X |
| 1,451,454 | 4/1923 | Beauchamp | 209/199 |
| 1,673,675 | 6/1928 | Hanceau | 209/43 X |
| 2,053,802 | 9/1936 | Nicol | 209/452 |

OTHER PUBLICATIONS

Taggart, A. F., Handbook of Mineral Dressing, Wiley & Sons Inc. New York, NY, 1945, pp. 2–81 & 2–84.

*Primary Examiner*—Ralph J. Hill

*Attorney, Agent, or Firm*—Quaintance, Murphy & Richardson

[57] ABSTRACT

The present invention relates to a method of extracting gold from placer gravel. Whereas conventional techniques are relatively effective in the processing of coarse gold particles, i.e. plus ten mesh tyler, the present invention finds application in recovery of gold particles of all sizes from submicroscopic through coarse nuggets larger than ten mesh tyler. A rotating sluice box uses centrifugal force to enhance the sluicing process, and a centrifugal amalgamator then extracts gold from the concentrate thus produced, under centrifugal force. Gold is removed from the mercury by conventional techniques.

1 Claim, 4 Drawing Figures

METHOD OF AND APPARATUS FOR EXTRACTION OF GOLD FROM PLACER GRAVEL

The present invention relates to a method for the removal of gold from placer deposits. Commonly used techniques for the extraction of gold from gold-bearing ore bodies are generally effective in the processing of coarse gold particles, i.e. plus ten mesh tyler; the high process costs involved do not economically justify their application to deposits containing large quantities of smaller particles of gold.

The present invention is designed for application to placer deposits for the recovery of large and/or small particles of gold in a single pass process, thus obtaining maximum recovery from excavation and other costs.

Extraction of gold is achieved through stages of (1) washing (2) screening (3) sluicing, and (4) mercury amalgamation, all of which will be described subsequently in greater detail.

It is known that in such deposits the gold is found in greater proportions in smaller particles of material than in the larger particles. For example, estimates of distribution of gold in placer deposits indicate that whereas only about twenty-five percent of the material in the deposit will pass ten mesh tyler screen, approximately ninety percent of the total gold content of the deposit is contained in the material which passes through the ten mesh tyler screen. Actual particles of gold may range in size from nuggets of about one-half inch in diameter to particles microscopic in size, weighing a small fraction of one milligram.

The relatively heavy weight of gold (specific gravity of about 19) is a key factor in separation of gold from other materials by sluicing; less dense particles are washed away by rapidly flowing water whereas denser gold-bearing particles, as a result of the higher gravitational forces acting on them, tend to settle in the sluicing tray for subsequent recovery.

As previously mentioned, gold in placer deposits tends to be in small particles, and because gold is extremely ductile these particles tend to flatten and bend rather than fracture. As a result, the gold particles tend to have a relatively high ratio of surface area to weight, thus making them susceptible to being swept away with lighter waste particles during sluicing, despite their higher specific gravity. The present invention involves the use of a rotating sluice box which has the effect of increasing the forces acting on the placer deposit material in a sluicing process many times beyond that of gravity alone, to the point where the differences between the settling forces acting on the gold and the other material more than overcomes the tendency of the gold particles to be swept away, and thereby favours the collection of gold particles in the sluice box.

Gold-bearing material collected by the rotating sluice box is then further refined by passing it through a "centrifugal amalgamator", a device which exposes the gold-bearing material to a "pond" of mercury under centrifugal force. The mercury chemically amalgamates with some of the gold, for removal by known processes. Gold particles which do not chemically combine with the mercury sink in the mercury and may be physically recovered therefrom whereas the less dense waste material will float over the pond of mercury and passes to waste.

The present invention comprises a method of extracting gold from a gold-bearing placer deposit comprising the steps of: excavation of the deposit of placer gravel; washing the deposit with water; classifying the deposit so as to remove all particles of the deposit greater than a prescribed size, leaving gold-bearing material for further processing; simultaneously subjecting the gold-bearing material to a force (such as centrifugal force) greater than the force of gravity and to a stream of flowing water, such that the stream of flowing water will flush from the gold-bearing material substantially all non-gold-bearing particles and will not flush an appreciable amount of gold-bearing particles away; removing gold nuggets from the gold-bearing particles; simultaneously subjecting the gold-bearing particles to a force (such as centrifugal force) greater than the force of gravity and placing the gold-bearing particles in contact with mercury, for sufficient time to allow a substantial portion of the gold-bearing particles either to form an amalgum with the mercury or to sink into the mercury; and removing the gold from the mercury.

A better understanding of the invention may be had by recourse to the drawings which illustrate one embodiment of the invention, and in which.

Figure 1:
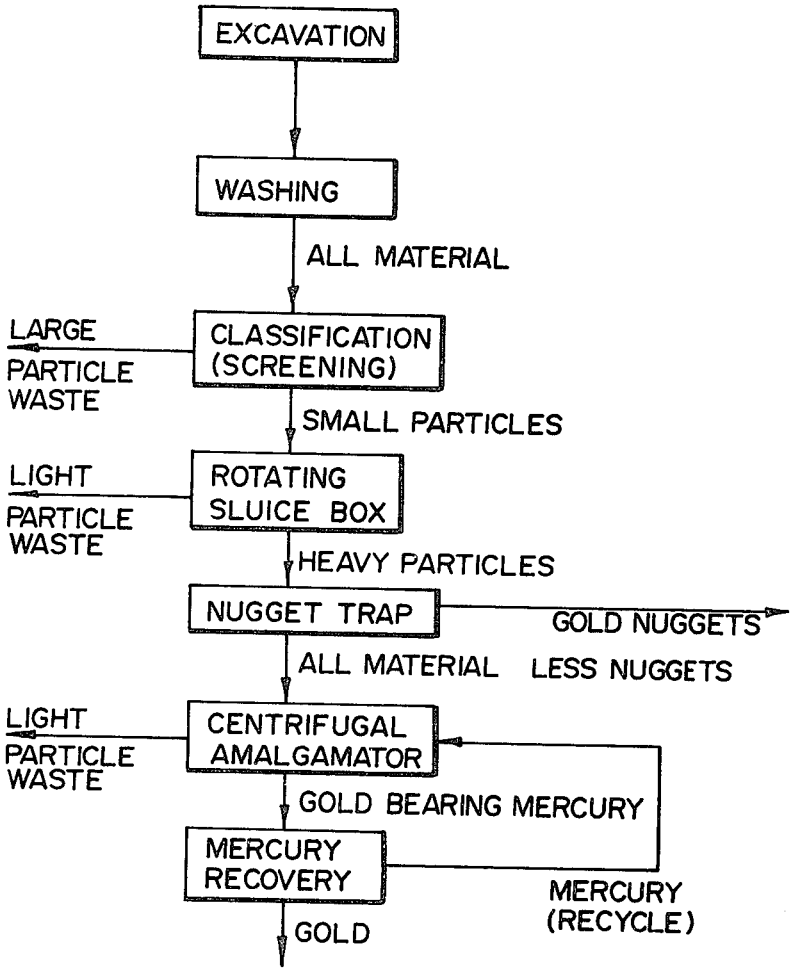
FIG. 1 is a flow diagram of the method of the present invention.

Referring now to the method outlined in the flow diagram in FIG. 1, the initial step in the gold extraction process is the excavation of the placer gravel from its deposit site. Excavation would be carried out in a conventional manner. As mentioned previously, relatively higher gold concentration is associated with smaller particles of the placer deposit, and accordingly it is desirable initially to wash material to be processed so as to separate clays and other plastic gold-bearing material from larger pieces of the placer deposit, lest the gold-bearing clays and plastic material be discarded with the large particles of waste at the screening stage to follow.

After washing, larger particles of placer deposits, which will not pass through, say, one-half inch mesh tyler screen, are cast off as waste tailings and are not treated further. Although a minor amount of the estimated gold content of the deposit may be lost wiTh the initial waste tailing, this loss is an economically justifiable trade-off since, in the relatively inexpensive washing and screening process, roughly seventy-five percent of the bulk of the placer deposit is removed from further processing. Moreover, the waste tailings which are removed are the larger particles of material which, before they can be processed further, would require being crushed or polarized.

Figure 2:
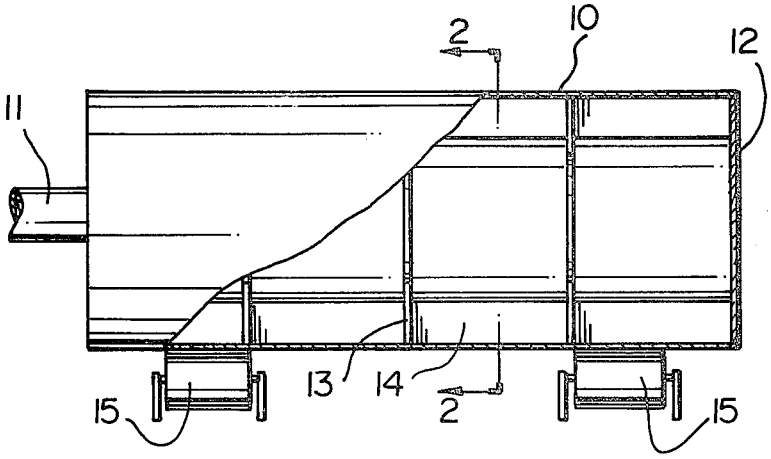
FIG. 2 is a side view, in section, of the rotating sluice box.
Figure 3:
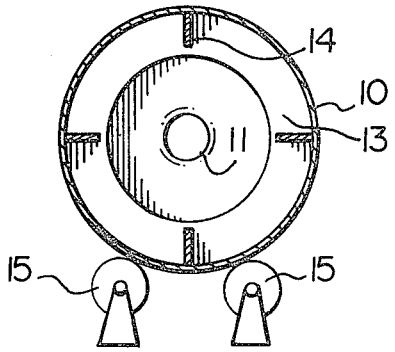
FIG. 3 is an end view, partly in section, along the axis of rotation of the rotating sluice box.

After the screening stage, all material which has passed through the appropriate screen size is placed in the rotating sluice box 10 shown in FIGS. 2 and 3. In the embodiment shown the wash water and gold-bearing material enters the rotating sluice box 10 through infeed pipe 11. The flow of water into the sluice box may be controlled so that the waste material will be flushed through the sluice box and out discharge port 12, carrying with it a minimum amount of gold. Baffles 13, disposed circumferentially on the inside surface of the sluice box 10 impede the passage of gold-bearing particles through the sluice box, as will be explained subsequently. Vanes 14, disposed longitudinally along the inside surface of the sluice box 10 prevent "slippage" of material along the inside surface of the sluice box, thereby ensuring that the material inside the rotating sluice box rotates at approximately the same speed as the sluice box itself. The sluice box 10 rotates on its longitudinal axis, and is supported by rollers 15 which may be drive units or simply idler rollers.

As the rotational speed of the sluice box 10 increases, the centrifugal force acting on its contents increases with the square of the rotational speed, according to the formula $$F=0.0000284\ n^2r$$

where

F is the centrifugal acceleration, in multiples of gravity, n is the rotational speed in revolutions per minute, r is the radial distrance of the contents from the axis of rotation in inches.

As the rotational speed of sluice box 10 is increased, and the centrifugal acceleration of the contents increases, the difference between the centrifugal force acting on the more dense gold-bearing particles and that acting on the less dense waste material become greater and greater.

For example, if the diameter of the sluice box 10 were about twenty inches, a rotational speed of 200 rpm. would produce an acceleration at the wall of the sluice box of about eleven time gravity. If we were to assume the gold-bearing material to have a specific gravity of about fifteen and the waste material a specific gravity of about six, the difference in the settling forces acting on equal masses of each would be in the order of 100 units of force in the rotating sluice box, as compared to about 9 units of force in a conventional sluice box operating under gravity alone. Thus the separation of the gold-bearing particles from the waste material is greatly enhanced by the centrifugal force exerted on the contents of the rotating sluice box 10.

Ultimately, the settling force on the gold-bearing particles becomes so great that the gold-bearing particles are virtually unaffected by the flow of water through the sluice box, whereas the less dense waste material, which is not subject to as great a settling force, is washed away by the flow of water through sluice box 10. The water and waste material leave the sluice box 10 through discharge port 12. After a period of time the gold-bearing particles which are not carried away, and which are effectively trapped in the sluice box 10 by baffles 13, may be removed by stopping the flow of material to be processed through infeed pipe 11, halting or slowing rotation of the sluice box 10, and then dumping out the material which has collected. Since the amount of gold to be recovered is exceedingly small, as compared to the total volume of material fed into the rotating sluice box 10, emptying of the sluice box is not a relatively frequent occurrence.

Following clean-out of the rotating sluice box, the gold-bearing material would then be subjected to a "nugget trap", typically a grate which will allow the smaller particles to fall through. The larger particles remaining are scanned by human eye, and any gold nuggets removed by hand; all the rest of the material (both the material which passes through the grate and the material which does not pass through the grate, after gold nuggets have been removed) passes on to the next stage.

As the diagram in FIG. 1 shows, the material which passes the nugget trap enters the centrifugal amalgamator for the final stage of the extraction process.

Figure 4:
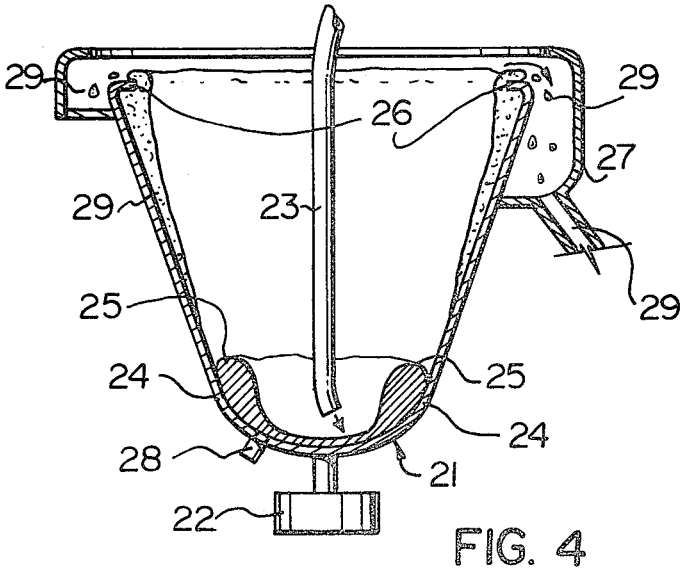
FIG. 4 is a side view, in section, of the centrifugal amalgamator.

The centrifugal amalgamator, shown in FIG. 4, consists of a bowl 21 rotatably mounted on drive unit 22 such that bowl 21 will rotate about a vertical axis. A feed and wash water inlet 23 is located that such inlet 23 will permit entry of the gold-bearing material feed, along with water, in proportions of about 1:3 into the bowl 21 at approximately the lowermost portion of bowl 21 near the rising wall 24. Prior to entry of the feed and water, bowl 21 is charged with a measured amount of mercury, as will be described subsequently. Bowl 21 is rotated by drive unit 22 to a speed such that the charge of mercury will, by virtue of the centrifugal force acting on it, rise up the walls 24 of bowl 21 to the position indicated by the "pond" 25 of mercury, as shown in FIG. 4, whereupon the gold-bearing material and water are permitted to enter into the rotating bowl 21 through inlet 23. As the gold comes into contact with the mercury, some of the gold will react with the mercury to form a mercury-gold amalgum. By virtue of the centrifugal forces acting on the contents of rotating bowl 21, gold-bearing particles will sink into the pond 25 of mercury, since the gold has a specific gravity greater than that of mercury. Waste material 29 on the other hand, having a density less than that of mercury will float on the pond 25 of mercury, and will spill over the lip 26 of bowl 21 to be carried by race 27 for disposal.

As soon as the pond depth has increased by a desired amount, by virtue of the gold which has sunk into the pond or has become amalgamated with the mercury, the feed through inlet 23 may be stopped, the bowl 21 brought to rest, and the mercury, with gold content, removed through port 28. Particles of gold or gold-bearing material may be removed from the mercury by decanting and/or filtering. Gold which has formed an amalgum with the mercury may be recovered by a conventional process. The mercury may be recycled to effect further gold extraction.

It will be understood that the method described above may be abridged or modified to suit the particular requirement of the placer deposit to be processed. For example, one might eliminate the centrifugal amalgamator and replace it with a second rotating sluice box. Alternatively, the rotating sluice box might be replaced by a sluice box operating under the force of gravity alone. While the invention has been illustrated and described as embodied in a gold-extraction process, it is not intended to be limited in terms either of the peculiarities of the steps involved or of the application to gold. The invention might also usefully be applied to the recovery of platinum or other metals having properties which would render application of the invention workable and appropriate.

The embodiments of the invention in which an exclusive property or privilege is claimed are defined as follows:

1. In a method of extracting precious metal from a precious metal bearing ore deposit, the improvement comprising the steps of:

providing a rotatably mounted cylindrical drum having a substantially horizontally disposed axis, said drum having an input end, an output end, and an internal peripheral surface, said input end being substantially closed about an opening adapted for flowing a slurry of precious metal ore into said drum, the internal peripheral surface of said drum having a plurality of spaced annular riffles of predetermined height, and at the output end having a plurality of longitudinally circumferentially spaced riffles of a height less than said annular riffles, flowing a slurry of precious metal bearing ore through said opening in said input end at a predetermined flow rate while simultaneously rotating said drum at a predetermined speed about its axis whereby, as the tank rotates, the slurry is caused to flow continuously in helical fashion over the longitudinal and annular riffles causing settling of precious metal fines, the fines being retained adjacent the inner peripheral surface of said drum due to centrifugal force caused by said drum rotation, and non-precious metal bearing material not affected by the same centrifugal force being flushed from the outlet of said drum.

* * * * *